US006559368B1

(12) United States Patent
Sikra et al.

(10) Patent No.: US 6,559,368 B1
(45) Date of Patent: May 6, 2003

(54) CUSHIONED PERCUSSION DEVICE

(75) Inventors: Richard A. Sikra, Palmdale, CA (US); Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/942,302

(22) Filed: Aug. 30, 2001

(51) Int. Cl.[7] ..... G10D 13/02
(52) U.S. Cl. ..... 84/421; 84/406; 84/403
(58) Field of Search ..... 84/406, 421, 402, 84/403, 404; 248/421

(56) References Cited

U.S. PATENT DOCUMENTS 5,684,258 A * 11/1997 Liao ..... 224/910
6,015,128 A * 1/2000 Lombardi ..... 248/218.4
6,028,258 A * 2/2000 Hicks et al. ..... 84/421

* cited by examiner

*Primary Examiner*—Kim Lockett
(74) *Attorney, Agent, or Firm*—William W. Haefliger

(57) ABSTRACT

The cushioned percussion device, comprising in combination, a projecting support for the device; a pivot for said support, and spring structure located to yieldably resist pivoting of the support.

10 Claims, 3 Drawing Sheets

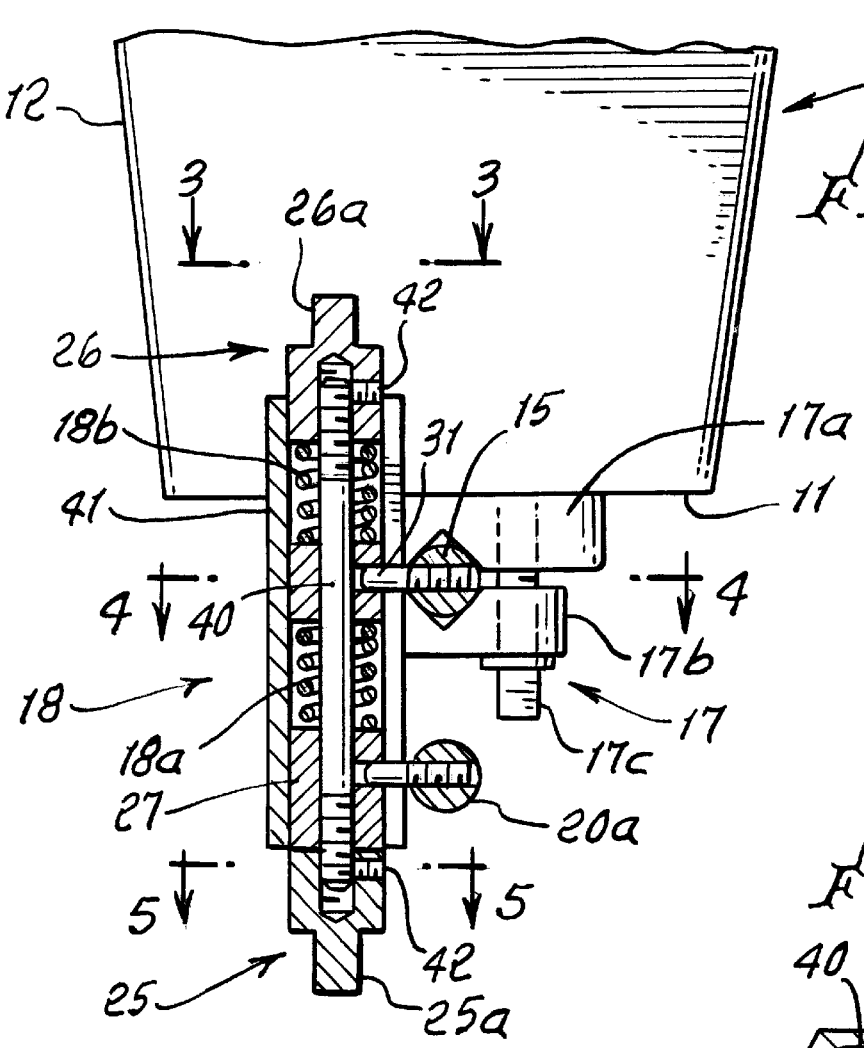
FIG. 2.
FIG. 4.
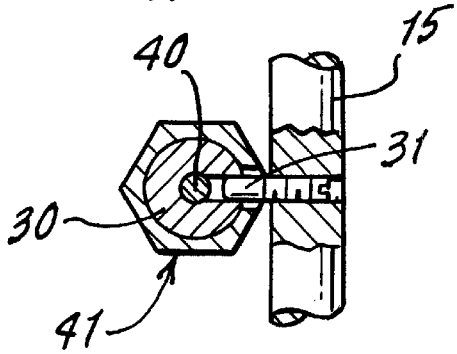
FIG. 3.
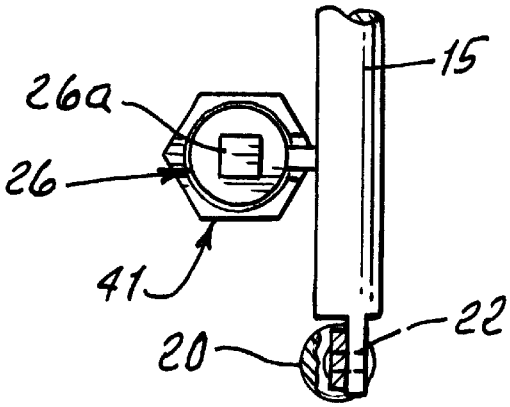
FIG. 5.
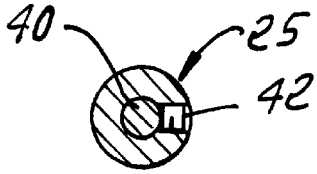

CUSHIONED PERCUSSION DEVICE

BACKGROUND OF THE INVENTION

This invention relates generally to the support of percussion devices, as for example cowbells; and more particularly relates to cushioning and adjustable cushioning of such devices.

When percussionists use drum sticks to forcibly strike cowbells that are rigidly supported, there is considerable shock effect transmitted back to the percussionist's hand and wrist. This reaction "hardness" differs substantially from the lower level impact effect created when a drum head is struck. There is need to alleviate at least in part such shock effect, which can be increasingly undesirable when the cowbell is struck with great force. Also, there is need for adjusting such created reaction effect when the cowbell is struck, i.e. for "tuning" of the cowbell.

SUMMARY OF THE INVENTION

It is a major object of the invention to provide a solution to the above problem, which meets the percussionist's needs. Basically, the invention is embodied in the provision of a cushioned percussion device that comprises:

a) a projecting support for the device, b) a pivot for the support, and c) spring structure located to yieldably resist pivoting of the support.

As will be seen, the spring structure may advantageously include a first spring element to resist pivoting in one direction, and a second spring element to resist pivoting in the opposite direction. A carrier typically carries that structure offset from the pivot and offset from a clamp or holder holding the percussion instrument in a position to be struck.

It is another object to provide an adjuster to adjust the tension of the spring structure, for controlling the yieldable resistance to pivoting of the support. As will be seen, two adjustable spring elements or portions may be provided to adjust yieldable resistance to pivoting, in two directions.

Yet another object includes provision of support structure including a strut yieldably supporting a cowbell lower portion; and a holder or clamp adjustably connecting the cowbell lower portion to the strut in spaced relation to the spring or springs, to enable adjustment of the clamp and cowbell lower portion toward or away from the spring or springs.

Accordingly, the cowbell cushioned support apparatus may be "tuned" at up to three locations, to optimize the selectability of cushioned support for the cowbell, to individually suit requirements of different percussionists.

These and other objects and advantages of the invention, as well as the details of an illustrative embodiment, will be more fully understood from the following specification and drawings, in which:

DRAWING DESCRIPTION

FIG. 2 is a cross-section taken on lines 2—2 of FIG. 1;

FIG. 3 is a plan view taken on lines 3—3 of FIG. 2;

FIG. 4 is a section taken on lines 4—4 of FIG. 2;

FIG. 5 is a section taken on lines 5—5 of FIG. 2; and

DETAILED DESCRIPTION

Figure 1:
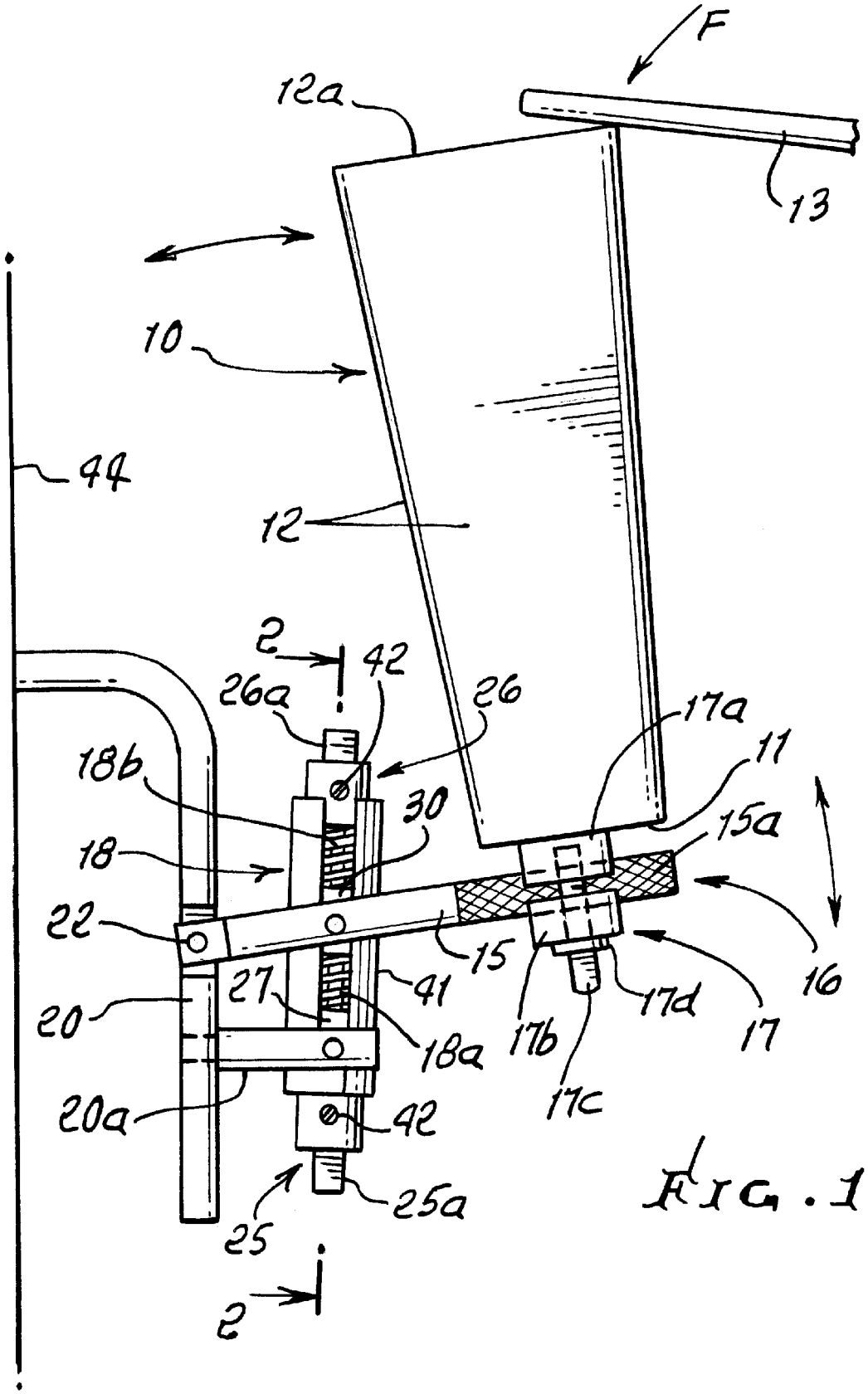
FIG. 1 is an elevation showing one preferred form of apparatus.

In the drawings a percussion instrument or device is shown at 10, and may take the form of a cowbell. It has a lower wall portion 11, and upwardly diverging walls 12. The cowbell is to be forcefully struck as by a drum beater or stick 13, during a performance or during practice. Upper rim 12*a* can also be struck.

In accordance with the invention, support structure is provided yieldably and resiliently supporting the cowbell lower portion 11 to enable the cowbell to bodily deflect when struck. The illustrated example shows such support structure to include a projecting support such as a strut 15 connected to the cowbell lower portion, as for example at 16. That connection may advantageously include a clamp 17 having an upper part 17*a* and a lower part 17*b* at opposite sides of the strut, and which may be loosened to allow adjustment shifting of the cowbell lengthwise of the strut, toward or away from cushioning spring structure 18. The clamp 17 may then be tightened, as on a threaded part 17*c*. Such adjustment shifting facilitates adjustment of stiffness of cowbell deflection, when struck, to suit the requirements of the percussionist. The strut 15 may comprise a metal rod, which is knurled as shown at 15*a* to facilitate non-slip connection of the clamp to the rod. A clamp adjuster is seen at 17*d*.

The spring structure 18 and strut 15 may be carried by a carrier, as for example a second strut or rod 20 having a projection 20*a*. Strut 15 may have connection to rod 20, as at a pivot 22, for allowing the cowbell to bodily move up and down. The spring structure is carried for resiliently and yieldably resisting such bodily movement of the cowbell.

In the example, a first spring or spring portion 18*a* is positioned to resist downward pivoting of the strut 15; and a second spring or spring portion 18*b* is positioned to resist upward pivoting of the strut 15. Spring portion 18*a* is shown as located below strut 15 and spring portion 18*b* above strut 15; however, the spring portions may have other positions.

In accordance with a further feature of the invention, the stiffness of one or both of the spring portions may be adjusted, to the requirements of the percussionist, whereby the stiffness of cowbell deflection is adjustable. In the example, a first adjuster 25 is provided to adjust the tension of the first spring portion 18*a*, and a second adjuster 26 is provided to adjust the tension of the second spring portion 18*b*. The first adjuster may have threaded connection to one end of a spring positioner 27, whereby when rotated at 25*a*, the spring portion 18*a* is controllably compressed; and the second adjuster may have threaded connection to the opposite end of positioner 28, whereby when rotated at 26*a*, the spring portion 18*b* is controllably compressed.

The spring portion 18*a* is compressed between adjuster 25 and a locater or connector 30; and the spring portion 18*b* is compressed between adjuster 26 and connector 30. That connector transmits spring force to the strut 15, at location 31, and the latter may include a pivot connection to the strut. See also guide pin 40, thread connected to 25 and 26, and tubular housing 41 for 25, 26 and 30. Set screws 42 when tightened fix the selected adjustment. Projection 20*a* carries housing 41.

In operation, when the cowbell is heavily struck, as by force F, the strut 15 is pivoted downwardly, and coiled spring portion 18*a* is momentarily compressed. As the strut 15 thereafter pivots or returns upwardly, upper spring portion 18*b* is momentarily compressed; and the compressions of the two spring portions can be adjusted to adjust the stiffness of deflection of the cow bell, during play, to meet the requirements of the percussionist.

Carrier rod 20 may be suitably connected to an upright stand, such as a cymbals stand 44.

Figure 6:
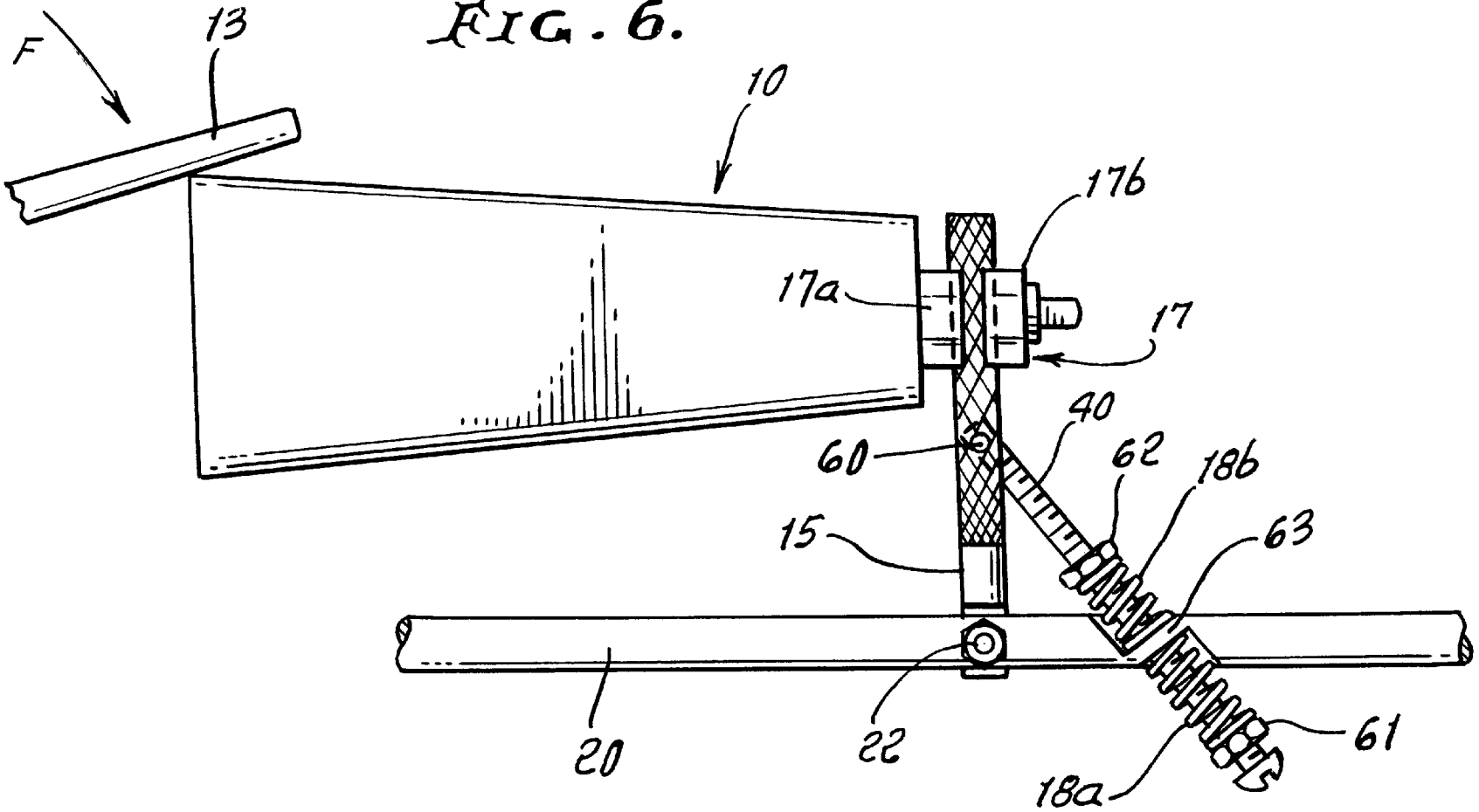
FIG. 6 is an elevation like FIG. 1, but showing a modified form.

In FIG. 6 the elements are generally the same as in FIG. 1, except for the following: the carrier pin 40 for the springs has pivotal connection at 60 to the strut 15; coil spring 18*a* is compressed between an angled region 63 of rod 20 and a nut 61; and coil spring 18*b* is compressed between angled locater region 63 and a nut 62. The two nuts are threaded on the pin 40, for adjustment to adjust the tension of the two springs, which control the yieldability of the cow bell when struck as by drum stick 13. Such yieldability is indicated by pivoting of the strut 15 about pivot 22. Nuts 61 and 62 are one form of pushers.

We claim:

1. A cushioned percussion device, comprising, in combination:

a) a projecting support for the device;

b) a pivot for said support, and c) spring structure located to yieldably resist pivoting of the support, d) said spring structure including a first coil spring element to resist device pivoting in one direction, and a second coil spring element to resist device pivoting in the opposite direction, said first and second spring elements extending in generally linearly opposite directions, pin means extending within said coil spring elements, and spring tension adjusters for the respective springs, threadably engaging said pin means.

2. The combination of claim 1 including said device carried by said support.

3. The combination of claim 2 including said device which is a cowbell, flaring in a direction to be struck by a drum stick or drum beater.

4. The combination of claim 1 wherein said pin means extends within each of said spring elements.

5. The combination of claim 1 including a spring structure carrier offset from said pivot.

6. The combination of claim 1 wherein said adjusters include a first adjuster to adjust said first spring element to vary its yieldable resistance to pivoting of the support in a first direction.

7. The combination of claim 6 wherein said adjusters include a second adjuster to adjust said second spring element to vary its yieldable resistance to pivoting of the support in a second direction, said adjusters being in alignment.

8. The combination of claim 1 wherein said spring elements are colinear coil springs having ends to be displaced in response to pivoting of the support.

9. The combination of claim 3 including a clamp adjustably connecting the cow bell to the strut in spaced relation to the springs, to enable adjustment of the clamp and cow bell end portion toward or away from the springs.

10. The combination of claim 1 wherein said adjusters include two pushers respectively transmitting opposite pushing forces to the spring elements, a locator between the spring elements, and including and a pivot carrying the locator.

* * * * *